US006573465B1

(12) United States Patent
Doepner

(10) Patent No.: US 6,573,465 B1
(45) Date of Patent: Jun. 3, 2003

(54) CONTACT SWITCH

(75) Inventor: Matthias F. W. Doepner, Harleysville, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 10/059,805

(22) Filed: Jan. 29, 2002

(51) Int. Cl.[7] ..... H01H 25/04
(52) U.S. Cl. ..... 200/6 A; 200/43.04
(58) Field of Search ..... 200/4, 5 R, 6 A, 200/17 R, 18, 332, 335, 43.04; 250/221

(56) References Cited

U.S. PATENT DOCUMENTS

| | | | | |
|---|---|---|---|---|
| 2,109,678 A | | 3/1938 | Nelson | 200/52 |
| 2,163,122 A | | 6/1939 | Hooker | 273/118 |
| 2,184,868 A | | 12/1939 | Williams et al. | 200/52 |
| 2,212,097 A | | 8/1940 | Gensburg | 200/52 |
| 2,275,005 A | | 3/1942 | Bevington | 273/118 |
| 2,277,274 A | | 3/1942 | Stoner et al. | 200/52 |
| 2,302,184 A | | 11/1942 | Caestecker | 200/52 |
| 2,311,392 A | | 2/1943 | Heiss | 200/52 |
| 2,487,979 A | | 11/1949 | Neyens | 200/52 |
| 2,501,021 A | | 3/1950 | Benak | 273/118 |
| 2,727,743 A | | 12/1955 | Von Stoeser | 273/118 |
| 2,804,514 A | | 8/1957 | Peters | 200/61.11 |
| 3,699,296 A | | 10/1972 | Harris | 200/67 DB |
| 3,906,176 A | * | 9/1975 | Carlson | 200/43.04 |
| 4,171,470 A | * | 10/1979 | Gettig | 200/6 A |
| 4,203,602 A | | 5/1980 | Kral | 273/121 A |
| 4,748,441 A | * | 5/1988 | Brzezinski | 200/6 A |
| 5,349,881 A | * | 9/1994 | Olorenshaw et al. | 200/6 A |
| 5,675,309 A | * | 10/1997 | DeVolpi | 200/6 A |

* cited by examiner

*Primary Examiner*—Michael Friedhofer
(74) *Attorney, Agent, or Firm*—Schweitzer Cornman Cross & Bondell LLP

(57) ABSTRACT

A contact switch for a kinetic activity amusement game has a base, a universal joint connected to the base and a contact bumper connected to a ball of the universal joint. A electrically conductive coil spring has one end connected to the ball of the universal joint and a second end retained by the base. An electrode has contact portions disposed radially around the coil spring. A power source is connected between the coil spring and the electrode forming a potential electrical circuit. Displacement of the contact bumper by kinetic energy of a game ball causes displacement of the coil spring and contact of the coil spring with the contact surfaces of the electrode closing the circuit.

6 Claims, 4 Drawing Sheets

CONTACT SWITCH

FIELD OF THE INVENTION

The invention pertains to the field of contact switches, and in particular, to contact switches for kinetic activity amusement games.

BACKGROUND OF THE INVENTION

Kinetic activity amusement games, such as pin ball and the like, typically include a game board having a playing surface with a plurality of deflectors and obstacles attached thereto, one or more game balls, and means to urge the game balls onto and within the game board.

Such amusement games also typically include electronic contact switches having bumper portions responsive to impact by a game ball rolling on the game board such that when a game ball impacts the contact switch with sufficient energy, the contact switch is temporarily closed, completing an electrical circuit through the switch. The closed state of the contact switch can serve to increment a game score, or can serve some other game-related purpose such as initiating a sound or a secondary kinetic activity in the game board.

Such contact switches typically include means to bias the switch into a rest position (usually an electrically "open" condition), such that after an impact of the switch by a game ball and the subsequent rebound of the game ball, the contact switch returns to the rest (i.e., open) position.

SUMMARY OF THE INVENTION

The present invention pertains to a contact switch for a kinetic activity amusement game, such as described above. The kinetic activity amusement game has a game board with a playing surface upon which a game ball may roll. The contact switch has a contact bumper portion located above the playing surface of the game board, which contact bumper is removably connected to a universal joint having a ball mounted within a complementary socket located within an interior space of the game board. The contact bumper is responsive to impact by a game ball rolling on the game board—approaching from any angle—such that when a game ball impacts the contact bumper with sufficient kinetic energy, the contact bumper deflects (i.e., rotates about the universal joint) and the contact switch is temporarily closed, completing an electrical circuit through the switch. The closed state of the contact switch can serve to increment a game score, or can serve some other game-related purpose such as initiating a sound or a secondary kinetic activity in the game board.

The contact switch includes an electrically conductive coil spring having a first end connected to the ball of the universal joint and a second end in contact with a base. An electrode has contact portions disposed in a circular pattern around the coil spring between the two ends of the coil spring. When the contact switch is in a rest position, the coil spring is in a substantially at-rest condition, and the contact portions of the electrode are disposed substantially concentrically around a longitudinal axis of the coil spring and are spaced radially outwardly from an outside surface of the coil spring.

A power source is connected between the coil spring and the electrode. In the rest position, the contact switch is in an "open" condition. When a game ball impacts the contact bumper, the contact bumper is deflected thereby rotating the ball of the universal joint and distorting the coil spring.

When the contact bumper and ball of the universal joint deflect a predetermined distance (angle), the coil spring contacts the contact portions of the electrode thereby completing (i.e., "closing") the circuit comprising the power source the coil spring and the electrode.

A semi-rigid elongated biasing element, such as a wire element, extends from the ball of the universal joint and contacts the base portion. The biasing element is substantially aligned with the longitudinal axis of the coil spring, when the contact switch is in the rest position. The biasing element is in a substantially at-rest condition when the contact switch is in the rest position and is in a distorted condition when the switch is in the closed condition, whereby the biasing element serves to bias the contact switch toward the rest position.

After the game ball rebounds from the contact bumper, the coil spring and/or the biasing element serve to return the switch to the rest position (i.e., the "open" condition), with the contact bumper and biasing element substantially aligned with the longitudinal axis of the coil spring.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
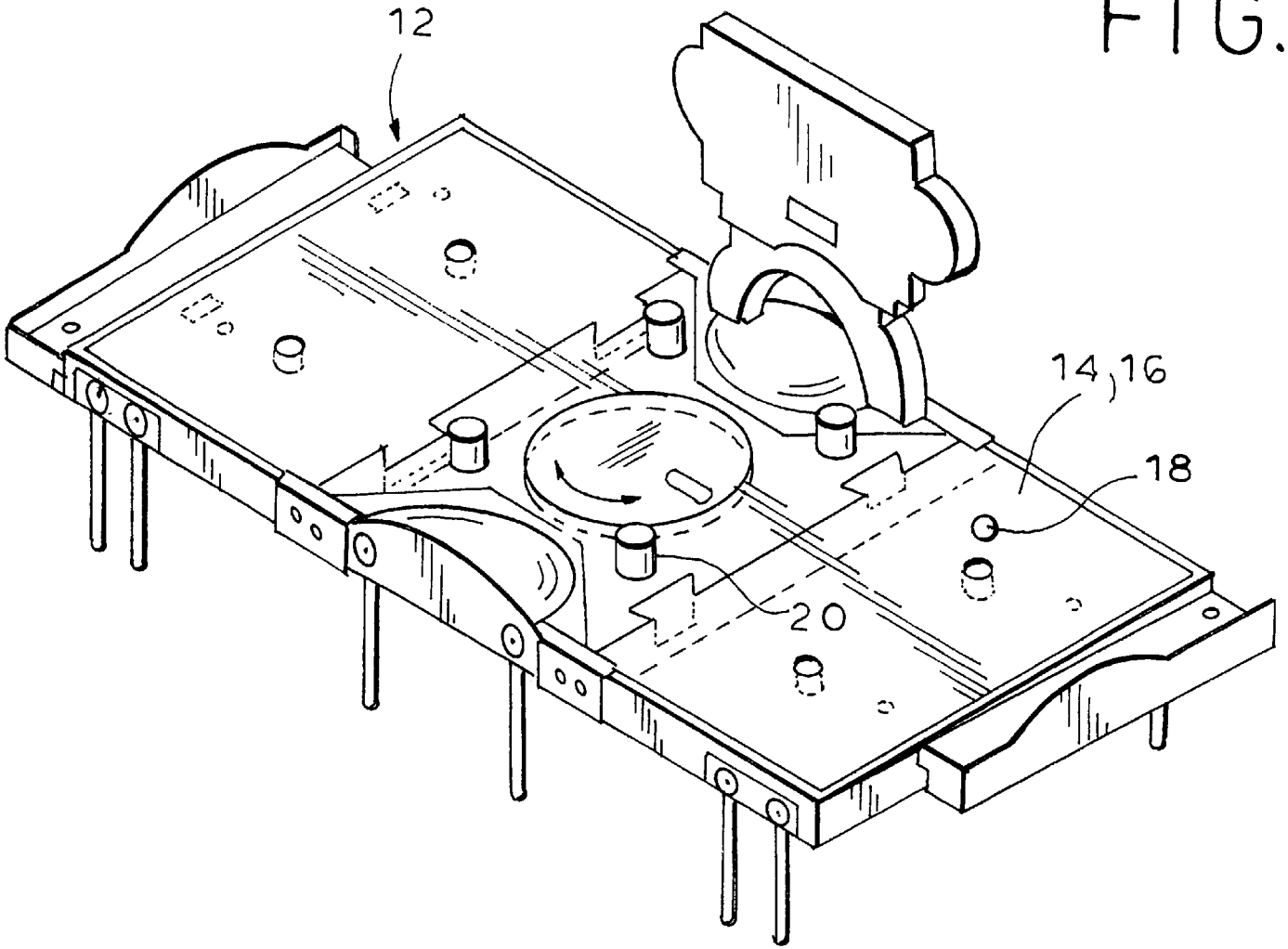
FIG. 1 is a perspective view of a kinetic activity amusement game having a contact switch constructed according to the present invention.
Figure 2:
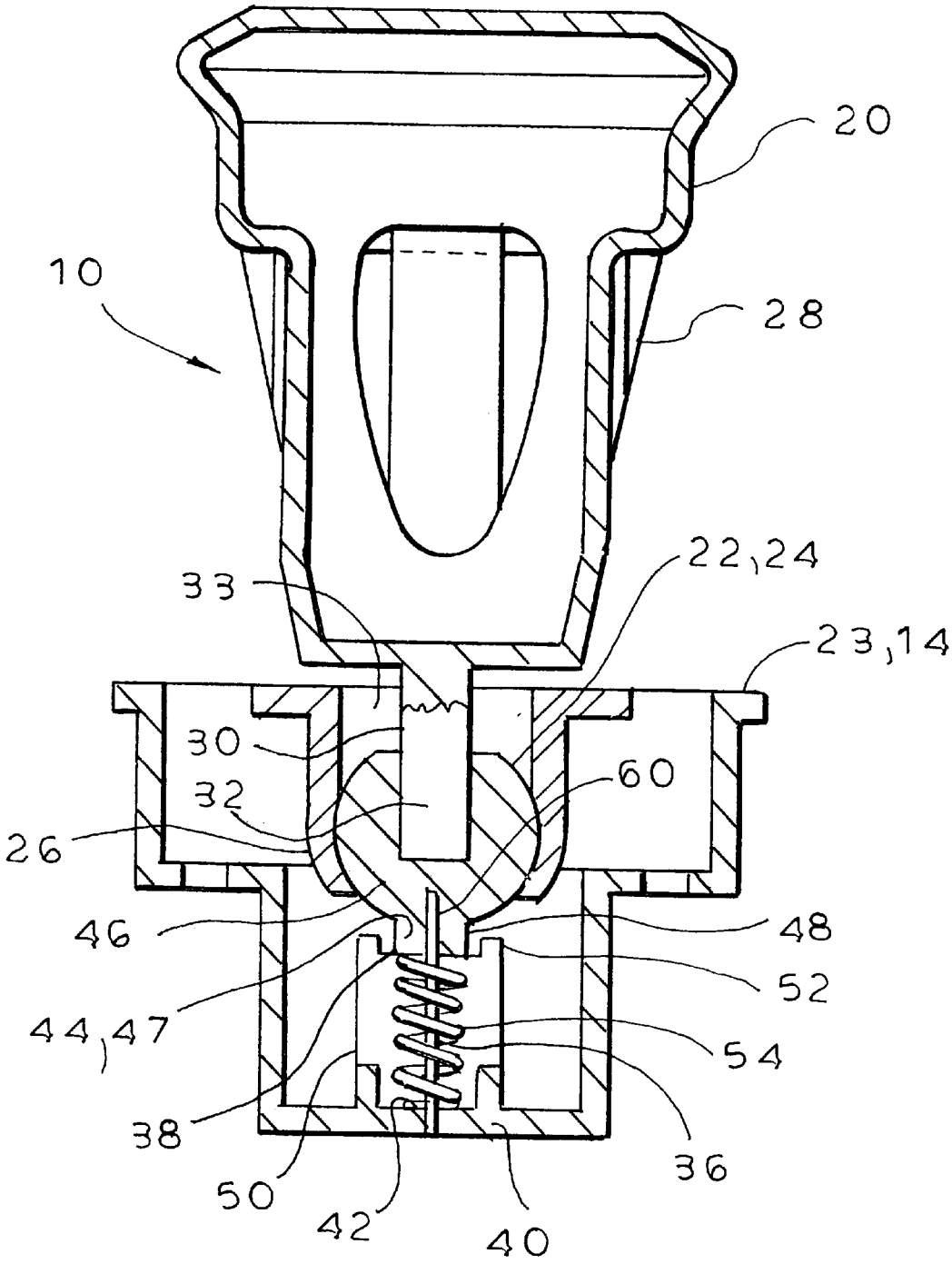
FIG. 2 is a cross-sectional elevational view of a contact switch constructed according to the present invention.

Referring to FIGS. 1& 2, the present invention is a contact switch 10 suitable for use with a kinetic activity amusement game 12 having a game board 14 forming a playing surface 16 upon which a game ball 18 may roll and impact and deflect a contact bumper 20 of the contact switch 10. The amusement game 12 may suitably be of the type disclosed in the co-pending U.S. utility patent application of Matthias Doepner, et al., entitled "Game Board Structure for Construction Toy Set," filed concurrently with the present application.

The contact switch 10 of the present invention includes a base 23 connected to the game board 14, and a universal joint 22 having a ball element 24 rotatably mounted within a socket 26 located within an interior portion of the game board 14. The contact bumper 20 includes a body portion 28 and a stem 30 projecting (downwardly) from said body portion 28. The ball element 24 of the universal joint 22 includes a stem-receiving recess 32 sized and shaped to closely removably receive the stem 30 of the contact bumper 20, such that the contact bumper can be removably connected to the universal joint 22.

To attach the contact bumper 20 to the universal joint 22, the stem 30 is extended through a preferably circular opening 33 in an outside (i.e., playing) surface 34 of the game board 14 and is removably inserted into the stem-receiving recess 32 of the ball element 24.

An electrically conductive coil spring 36 has a first (upper) end 38 connected to the ball element 24 of the universal joint 22 and has a second (lower) end 40 retained by the base 23, preferably within a recess 42 thereof. Preferably, the ball element 24 includes a spring-retaining projection 44 having a base 46 with a first diameter and an end portion 47 with a second diameter. The first and second diameters of the spring-retaining projection 44 are greater than and less than an inside diameter of the coil spring 36, respectively. The first end 38 of the coil spring 36 is disposed around the spring-retaining projection 44 of the ball such that an extreme end portion 48 of the first end 38 of the coil spring abuts the base 46 of the spring-retaining projection. Preferably, the end portion 47 of the spring-retaining projection 44 is sized and shaped to closely fit within the coil spring.

The spring-retaining projection 44 serves to substantially fix the first end 38 of the coil spring 36 with respect to the ball element 24 of the universal joint such that movement of the ball element 24 will induce necessary movement in the first end 38 of the coil spring 36. The recess 42 in the base 23 preferably closely receives the second end 40 of the coil spring 36 therein to substantially prevent the movement of the second end 40 with respect to the base 23.

When the ball element 24 of the universal joint 22 is displaced from a rest position (i.e., as shown in FIG. 2), the first end 38 of the coil spring 36 is displaced radially outwardly relative to the longitudinal axis of the coil spring when in the rest position. When displaced from the rest position, the coil spring 36 is distorted from its elastically "at-rest" shape.

The coil spring 36 preferably serves to bias the contact switch 10 toward a rest position (i.e., as shown in FIG. 2). In the rest position, a longitudinal axis of the coil spring 36 is preferably substantially aligned with longitudinal axes of the contact bumper 20 (and its stem 30) and the stem-receiving recess 32 of the ball element 24 of the universal joint 22.

The contact switch 10 includes an electrode 50 having electrical contact portions 52 affixed to the base 23 and disposed in a substantially circular pattern intermediate the first and second ends 38, 30 of the coil spring 36. The contact portions 52 are preferably in the form of a contiguous annular contact ring 36, however the contact portions 52 can be discrete contact elements (not shown) in electrical contact with one another and the electrode 50. When the contact switch 10 is in the rest position (FIG. 2), the contact portions 52 are disposed substantially concentrically with the longitudinal axis of the coil spring 36 and are disposed radially outwardly from an outside surface 54 of the coil spring.

The contact switch 10 also includes a power source (not shown) connected between the electrode 50 and the coil spring 36, forming a potential electrical circuit between the power source, the coil spring 36 and the electrode 50. An electronic game component of any suitable type can be included in the circuit.

When in the rest position, as shown in FIG. 2, the circuit of the contact switch 10 is in an electrically "open" condition. When a game ball 18 rolling on the game board 14 impacts the contact bumper 20, the contact bumper 20 is displaced thereby rotating the ball element 24 of the universal joint and displacing (and distorting) the coil spring 36. If the game ball 18 impacting the contact bumper 20 has sufficient kinetic energy, the switch 10 is displaced into a "closed" condition wherein the coil spring 36 is in electrical contact with one or more of the contact portions 52 of the electrode 50 thereby completing the electrical circuit.

As set forth above, the closed state of the contact switch 10 can be used in the amusement game 12 to increment a game score, or can serve some other game-related purpose.

Preferably an elongated semi-rigid biasing element, such as a wire element 60, extends from the spring-retaining projection 44 of the ball element 24 substantially parallel to the longitudinal axis of the coil spring 36 when the switch 10 is in the rest position. When the contact switch 10 is in the rest position, the biasing element 60 is in a substantially elastically "at-rest" condition, and when the contact switch 10 is in the "closed". condition, the biasing element 60 is in a elastically distorted condition. Thus, the biasing element 60 preferably serves to bias the contact switch 10 into the rest position whereby, after the game ball 18 rebounds from the contact bumper 20, the coil spring 36 and/or the biasing element 60 serve to return the switch to the rest position (i.e., the "open" condition) with the contact bumper 20 and biasing element 60 substantially aligned with the longitudinal axis of the coil spring 36.

Preferably, the coil spring 36 can rotate relative to the ball element 24 or the base 23 about the longitudinal axis of the coil spring 36. Thus, the assembly of the contact bumper 20 and the ball element 24 can rotate about an axis substantially parallel to a longitudinal axis of the coil spring 36 without inducing substantial torsion in said coil spring 36, which reduces or eliminates the possibility that the contact switch 20 will be damaged by intentional or unintentional rotation of the contact bumper 20 relative to the base 23 by the user.

Figure 3:
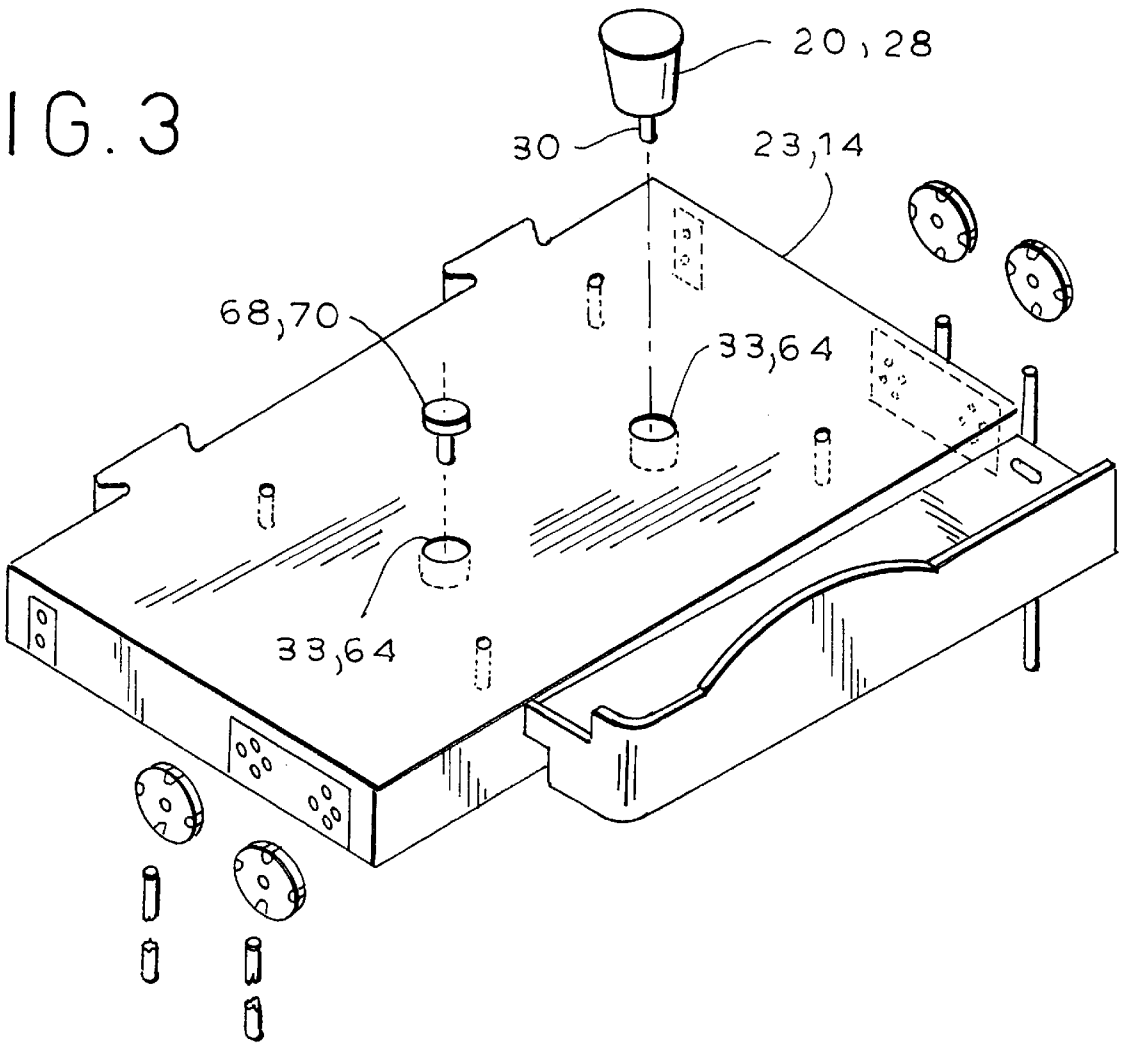
FIG. 3 is an exploded assembly view of a kinetic activity amusement game having a contact switch constructed according to the present invention, showing the contact bumper and plug alternately insertable within an opening in the game board.

Referring to FIG. 3, as disclosed in the co-pending application of Matthias Doepner, et al. mentioned above, an amusement game 12 suitable for the present invention may be altered by the user into one of a number of configurations, some of which may not require a working contact switch 10, or the contact bumper 20 thereof. Therefore, as described above, the contact bumper 20 is removably attached to the universal joint 22, such that it may be removed from the game board as desired by the user. However, the removal of the contact bumper 20 creates an open recess 64 in the game board 14. Such recesses are undesirable in kinetic activity amusement games involving game balls 18 rolling on a playing surface because, as can be appreciated, the game balls 18 can be undesirably deflected by or retained in the recess 64.

Figure 4:
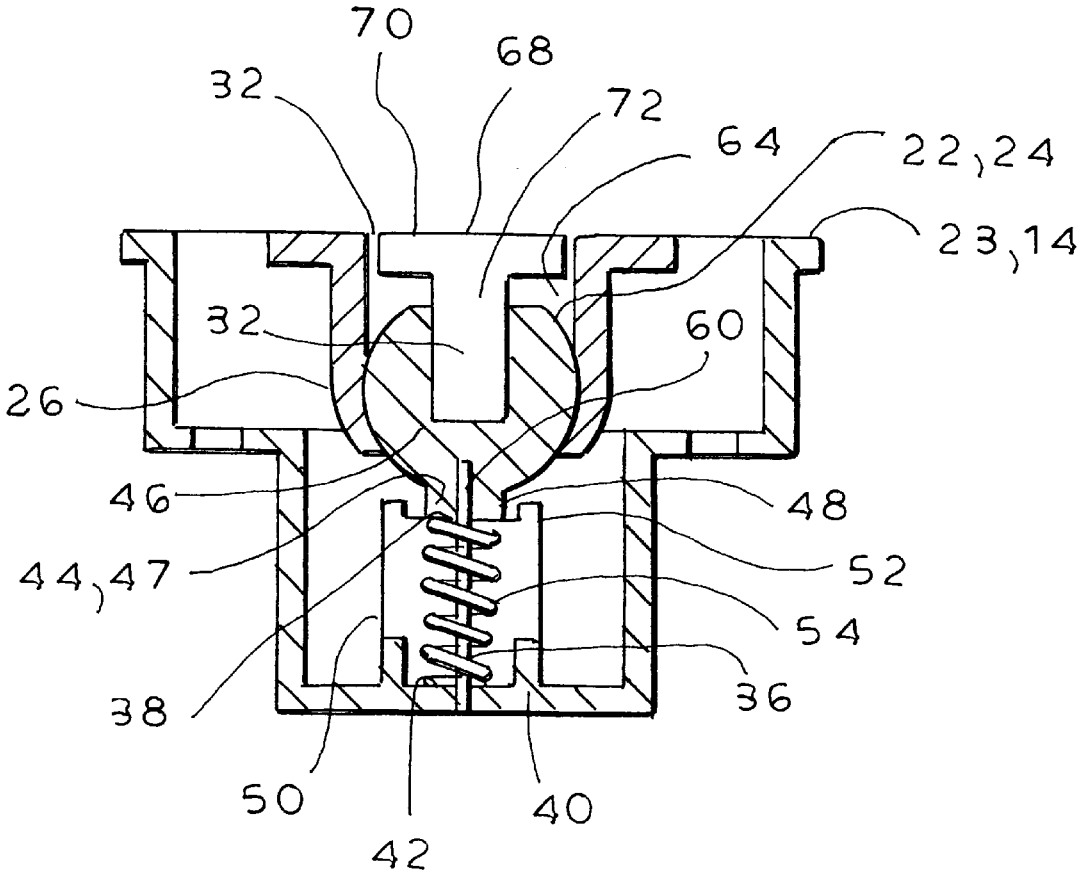
FIG. 4 is a cross-sectional elevational view of a contact switch constructed according to the present invention, showing the plug inserted within the recess of the game board.

Referring to FIG. 4, the contact switch 10 includes a preferably circular plug 68 sized and shaped to be closely received within the opening 32 and recess 64 in the game board 14. The plug 68 preferably has a planar top surface 70 which, when the plug 68 is inserted within the opening 32 and recess 64, is substantially co-planar with the playing surface of the game board 14. Preferably, the plug 68 has a stem 72 sized and shaped to be closely received within the stem-receiving recess 32 of the ball element 24 of the universal joint 22.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A contact spring switch for a game board, comprising:

a base a universal joint a contact bumper connected to the universal joint an electrically-conductive coil spring having an outside surface and having a first end connected to said universal joint and a second end in contact with said base an electrode having contact portions disposed intermediate said first and second ends of said coil spring, in a substantially circular pattern when said switch is in said rest position, said contact portions of said electrode being spaced radially outwardly from said outside surface of said coil spring, substantially concentric to a longitudinal axis of said coil spring a power source connected between said coil spring and said electrode said switch having an open condition wherein said switch is in said rest position and having a closed condition wherein said coil spring is in contact with one of said contact portions of said electrode, and said coil spring biasing said switch in said rest position.

2. A contact spring switch as in claim 1, wherein a semi-rigid, elongated biasing element having a first end connected to said universal joint and a second end in contact with said base said biasing element being substantially aligned with said longitudinal axis of said coil spring, when said switch is in a rest position, and said biasing element biasing said switch in said rest position.

3. A contact spring switch as in claim 2, wherein said contact bumper comprises a body portion and a stem portion projecting from said body portion said universal joint comprises a ball element and a socket, said ball element includes a stem receiving recess sized and shaped to closely and removably receive said stem of said contact bumper, and said contact bumper is removably attachable to said ball via said stem and said stem receiving recess.

4. A contact spring switch as in claim 3, wherein said base has a substantially planar outside surface with an opening therein said stem of said contact bumper extends through said opening when said contact bumper is attached to said ball element of said universal joint a plug is insertable in said opening when said contact bumper is removed from said ball portion said plug has a body portion sized and shaped to be closely removably received within said opening in said outside surface of said base, and said body portion has an outside surface that is substantially co-planar with said outside surface of said base when said plug is inserted in said opening.

5. A contact spring switch as in claim 1, wherein said universal joint comprises a ball element and a socket, said ball element includes a spring-retaining projection in contact with said first end of said coil spring said spring-retaining projection has a shoulder portion defined by a base portion with a first diameter and an end portion having a second diameter less than said first diameter said first diameter of said spring-retaining projection is greater than an inside diameter of said coil spring and said second diameter of said spring-retaining projection is less than said inside diameter of said coil spring said coil spring is disposed around said end portion of said spring-retaining projection with an end face of said first end of said spring in contact with said shoulder portion of said spring-retaining projection, and said base has a spring-retaining recess with a diameter greater than said outside surface of said coil spring, said second end of said coil-spring is disposed within said spring-retaining recess.

6. A contact spring switch as in claim 5, wherein an assembly of said contact bumper and said ball of said universal joint can rotate about an axis substantially parallel to said longitudinal axis of said coil spring without inducing substantial torsion in said coil spring.

* * * * *